United States Patent [19]

Sheiman et al.

[11] 4,422,212

[45] Dec. 27, 1983

[54] NON-READILY DETACHABLE LUGGAGE SUPPORT UNIT

[76] Inventors: Julius Sheiman; Samuel Sheiman, both of 247 Centre St., Crest Lock Co., Inc., New York, N.Y. 10013

[21] Appl. No.: 281,074

[22] Filed: Jul. 7, 1981

[51] Int. Cl.[3] ..... B60B 33/00

[52] U.S. Cl. ..... 16/29; 16/30; 190/18 A; 280/37; 403/329

[58] Field of Search ..... 16/18 R, 29, 30, 42 R, 16/42 T; 280/37; 190/18 A; 403/329

[56] References Cited

U.S. PATENT DOCUMENTS

| | | | |
|---|---|---|---|
| 3,935,613 | 2/1976 | Kaneko | 16/30 |
| 3,987,875 | 10/1976 | Szabo | 16/30 X |
| 4,332,052 | 6/1982 | Remington | 16/30 |

*Primary Examiner*—Fred Silverberg

*Attorney, Agent, or Firm*—Kirschstein, Kirschstein, Ottinger & Cobrin

[57] ABSTRACT

A detachable luggage-supporting, ground-engaging convertible accessory unit comprises a base member and at least one slide member which is guided for sliding movement on the base member. The base member is secured to a piece of luggage. A caster roller device is mounted on one slide member to form a caster roller assembly. A runner skid is connected to another slide member to form a skid-type runner assembly. A cantilever leaf spring on the base member snappingly engages each slide member for interconnecting the base member and the respective slide member with snap-type action. An access opening is formed on each slide member to expose the spring to permit a disassembly tool to remove the slide member from the base member, to thereby effect the rapid interchange of one caster roller assembly for another, or for the skid-type runner assembly. The slide member covers the spring except at the access opening so that the members are not readily detachable during luggage transport.

10 Claims, 7 Drawing Figures

NON-READILY DETACHABLE LUGGAGE SUPPORT UNIT

BACKGROUND OF THE INVENTION

1. Field of the Invention

This invention generally relates to a ground-engaging accessory unit for attachment to and detachment from luggage, suitcases and like objects which are transported from place to place by manual effort and, more particularly, to a detachable luggage caster roller unit and/or a detachable luggage skid-type runner unit. Still more particularly, this invention relates to a convertible arrangement for readily and easily interchanging a luggage caster roller unit with a skid-type runner unit, and vice versa.

2. Description of the Prior Art

It is well-known to attach many kinds of detachable caster roller units and/or skid-type runner units to one end of a suitcase or other item of luggage in order to facilitate the movement thereof. Although generally satisfactory for their intended purpose, the conventional detachable caster roller units have not proven to be altogether practical in use. The conventional caster roller units are generally inconvenient and cumbersome to attach to an article of luggage. Furthermore, once attached, the conventional caster roller assemblies are too easily detached from the luggage. It has been found that the detachable caster roller assemblies sometimes slip off the luggage during transport, thereby compelling the user to attempt to re-attach the caster roller assemblies. In some cases, the caster roller assemblies are lost, thereby making their re-attachment impossible. The problem of undesirable slipping-off of the caster roller assemblies from the luggage is aggravated in some constructions by the fact that the main connector, which actuates the disassembly, typically extends beyond the general outline of the other connecting parts of the unit, thus exposing the main connector to accidental displacement and consequent disassembly of the unit.

To prevent such accidental disassembly of the caster roller units, the component parts of the conventional caster roller units have been deliberately designed to be interconnected in a very secure locking arrangement which is not readily disassembled. Hence, it is extremely difficult for a user to interchange one caster roller assembly for another, or to interchange one caster roller assembly for a skid-type runner assembly. Indeed, the difficulty in disassembling such securely-locked caster roller units generally prevents such interchange from being effected.

SUMMARY OF THE INVENTION

1. Objects of the Invention

Accordingly, it is the general object of this invention to overcome the aforementioned drawbacks of the prior art constructions.

Another object of this invention is to provide a ground-engaging luggage-supporting unit, such as a caster roller unit and/or a skid-type runner unit, which is conveniently attachable to and detachable from luggage or analogous objects, but which does not separate therefrom during transport thereof.

An additional object of this invention is to provide a convertible arrangement for quickly and easily interchanging a caster roller assembly for a skid-type runner assembly, and vice versa.

Yet another object of this invention is to provide a ground-engaging luggage-supporting unit which is constructed of a minimum number of parts, and which is manufactured at low cost.

2. Features of the Invention

In keeping with these objects and others which will become apparent hereinafter, one feature of the invention resides, briefly stated, in a detachable ground-engaging accessory unit for supporting objects to be moved from place to place, particularly luggage, suitcases and the like. The accessory unit comprises a stationary base member which is adapted to be secured to the object to be moved, and at least one movable slide member which has a main body for operatively engaging the ground on which the object is to be supported. A caster roller device can be mounted on the main body of the slide member to constitute a caster roller assembly, or the main body can be formed with a raised runner skid to constitute a skid-type runner assembly. The caster roller assembly and skid-type runner assembly are each separately mounted on the base member.

The base member has an elongated substantially planar base wall, and a pair of side rails each extending at least partially along opposite respective longitudinal side edges of the base wall. The base member also has an elongated cantilever leaf spring which includes one spring end connected to the base wall, an opposite free spring end that acts as a locking bolt, and a resilient offset spring portion intermediate the spring ends and having a normal position lying out of the plane of the base wall.

Each movable slide member has a pair of side tracks each extending at least partially along opposite respective longitudinal side edges of the main body. The side tracks slidably engage the side rails so that the slide member is mounted on the base member for guided sliding movement between a disassembled and an assembled condition. Each slide member also has a leading detent portion for cammingly engaging and thereby urging the offset spring portion during said sliding movement towards the base wall until the leading detent portion of the slide member is slid past the free end spring locking bolt, whereupon the locking bolt due to its inherent resilience engages behind the detent portion with snap-type action to thereby secure the slide member and the base member in their assembled condition.

An access opening is provided on each slide member in the vicinity of the leading detent portion thereof. The access opening extends through the slide member to expose the spring located therebelow in the assembled condition. The access opening is dimensioned to receive therethrough a disassembly tool which is operative for displacing the offset spring portion back towards the base wall until the free spring end locking bolt clears the detent portion. The reception of the disassembly tool in the access opening permits the user to quickly and easily remove each slide member from the base member in order to effect an interchange between the caster roller assembly and the skid-type runner assembly. The snapping engagement of the leaf spring with each slide member permits the user to conveniently attach each unit to a piece of luggage with the absolute minimum number of parts. Because all but a minor portion of the spring is covered by the slide member, the above-described construction does not readily separate during transport of the luggage, thereby avoiding the prior art problem of losing the caster roller assemblies during transport.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENTS

Figure 1:
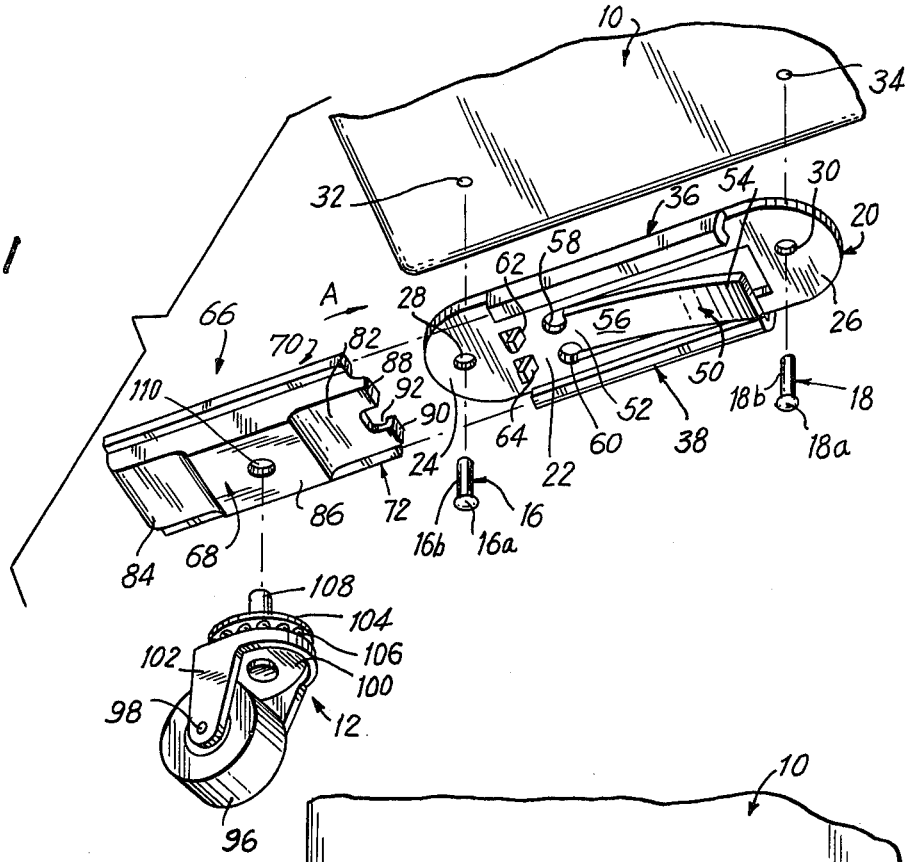
FIG. 1 is an exploded perspective view of a detachable ground-engaging accessary unit in accordance with this invention.
Figure 7:
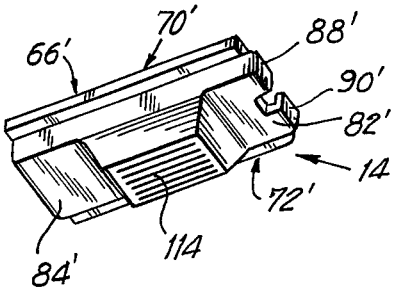
FIG. 7 is a perspective view of a skid-type runner assembly which can be interchanged in the FIG. 1 construction for the caster roller assembly.

Referring now to FIG. 1, reference numeral 10 generally identifies an object to be supported on the ground, and to be moved over the ground from place to place by manual effort. Typical examples of such objects 10 are luggage, suitcases and equipment whose transport over the ground is desired to be facilitated. The ground-engaging accessory units in accordance with this invention for supporting the object on the ground during its transport, preferably include a caster roller device 12 (FIG. 1) and/or a skid-type runner assembly 14 (FIG. 7). The structure and operation of the caster roller unit and/or of the runner unit will be described in the context of supportably transporting a piece of luggage 10 over the ground. However, it will be understood that this invention is not intended to be limited solely to applications involving luggage, but can be used with any object which is to be moved over the ground.

Figure 3:
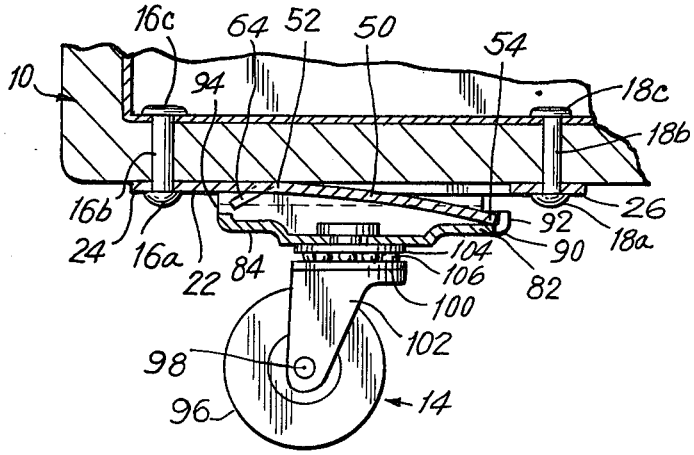
FIG. 3 is a broken-away sectional view as taken along line 3—3 of FIG. 2.

As best shown in FIG. 1, a stationary base member 20 is mounted on the aforesaid outer surface of the compartment 10 by a pair of fasteners, e.g. rivets 16, 18, which have heads 16*a*, 18*a*, and stems 16*b*, 18*b*, respectively. The base member 20 has an elongated substantially planar rectangular base wall 22 and a pair of rounded end regions or ears 24, 26. The ears 24,26 ad base wall 22 all lie in a common horizontal plane. Holes 28, 30 are respectively formed in ears 24, 26, and receive the stems 16*b*, 18*b* of the rivets 16, 18 with clearance. The rivet stems 16*b*, 18*b* are passed through juxtaposed holes 32, 34 respectively formed in the surface of the luggage 10, and thereupon, the ends of the rivet stems 16*b*, 18*b* which are opposite to the rivet heads 16*a*, 18*a* are peened over to form shoulders 16*c*, 18*c*, as shown in FIG. 3, in order to securely anchor the base member 20 in place on the luggage. Alternatively, headed nuts, in substitution for the peened-over shoulders 16*c*, 18*c*, could be mounted over the opposite ends of the rivet stems in order to anchor the base member 20.

Figure 5:
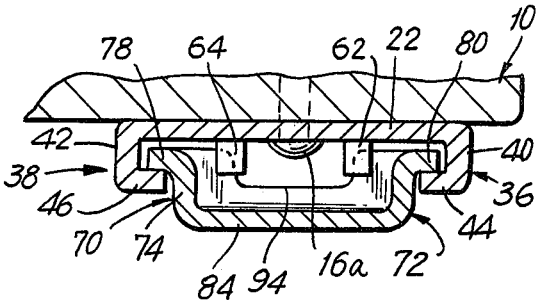
FIG. 5 is a broken-away sectional view as taken along line 5—5 of FIG. 2.

The base member 20 also has a pair of L-shaped side rails 36, 38 each extending at least partially along opposite respective longitudinal side edges of the base wall 22. As best shown in FIG. 5, each side rail 36, 38 has a depending vertical leg 40, 42, respectively, and a horizontal leg 44, 46 respectively. Each horizontal leg 44, 46 defines with the base wall 22 a clearance space through which cooperating side tracks, as described below, can be mounted for movement therealong.

The base member 20 further has an elongated cantiliver leaf spring 50 which has one end 52 connected to, and preferably of one-piece with, the base wall 22; an opposite free end 54 to function as a spring locking bolt; and a resilient offset spring portion 56 which is located between the spring ends 52, 54. The offset spring portion 56 is struck from the base wall, and is bent to assume a normal position in which the offset spring portion 56 lies out of the plane of the base wall, and preferably at an acute angle relative thereto. The offset spring portion 56 diverges relative to the base wall 22 in direction from the ear 24 towards the ear 26. In order to facilitate the bending of the offset spring portion 56 to its normally inclined position, circular notches 58, 60 are stamped out from the base wall 22 in the area adjacent the spring end 52 so that the latter has a reduced neck portion in the vicinity of its connection to the base wall 22.

The base member 20 still further has a pair of abutment stops or tongues 62, 64 which are also struck out from the base wall 22 in the area between the ear 24 and the spring 50. The operation of the tongues is described below in connection with FIG. 3.

Figure 2:
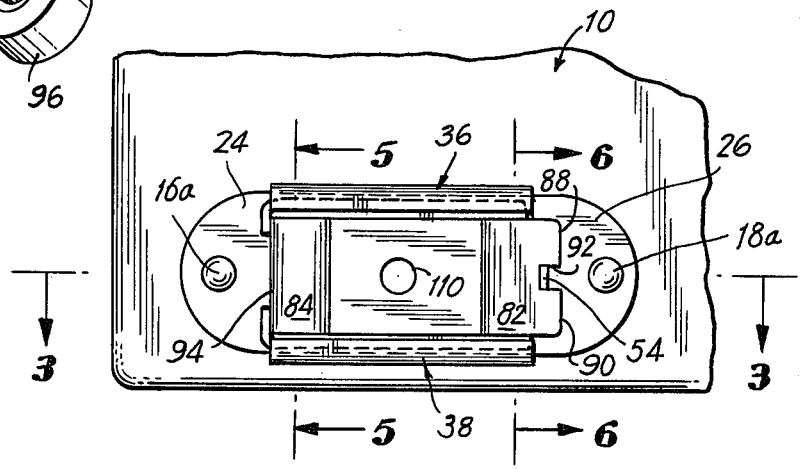
FIG. 2 is a broken-away bottom plan view of the unit of FIG. 1, with the caster roller device removed for the sake of clarity.

A movable slide member 66 has an elongated main body 68 and a pair of L-shaped side tracks 70, 72 each extending at least partially along opposite respective longitudinal side edges of the main body 68. As best shown in FIG. 5, the side tracks 70, 72 have vertical legs 74, 76, respectively, and horizontal legs 78, 80, respectively. The horizontal legs 78, 80 extend outwardly of the main body 68, and are received in the aforementioned clearance spaces defined between the horizontal legs 46, 44 and the base wall 22 of the base member 20. The side tracks 70, 72 slidably engage the side rails 38, 36 so that the slide member 66 is mounted on the base member 20 for guided sliding longitudinal movement therealong in the direction of the arrow A between a disassembled condition, as shown in FIG. 1, and an assembled condition, as shown in FIGS. 2 and 3.

As considered along the direction of advancement along the arrow A, the main body 68 has a leading end section 82, a trailing end section 84 and an intermediate body section 86. The leading end section 82 has a leading detent portion, i.e. a pair of downturned flanges or C-shaped curved arms 88, 90. An access opening 92 is formed in the leading detent portion intermediate the pair of detent arms 88, 90. The access opening 92 extends through the slide member 66 and exposes the spring 50, and particularly the free end 54 thereof, located therebelow in the assembled condition.

In order to mount the slide member 66 and the base member 20 in their assembled condition, the slide member 66 is moved along the advancement direction of arrow A such that the tracks 70, 72 slidably engage the rails 38, 36, respectively. As best seen in FIG. 3, the leading detent arms 88, 90 are located sufficiently away from, i.e. below, the rivet head 16*a* and also away from the abutment stops 62, 64 such that mechanical interference between these parts is avoided during the sliding movement. The detent arms 88, 90 do, however, cammingly engage and thereby urge the offset spring portion 56 during the sliding movement towards the base wall 22 of the base member 20. The detent arms 88, 90 essentially urge the offset resilient spring portion 56 from its normally inclined and relaxed position to a less inclined and stressed position in which the resilient spring portion 56 exerts a restoring force against the detent arms.

Figure 6:
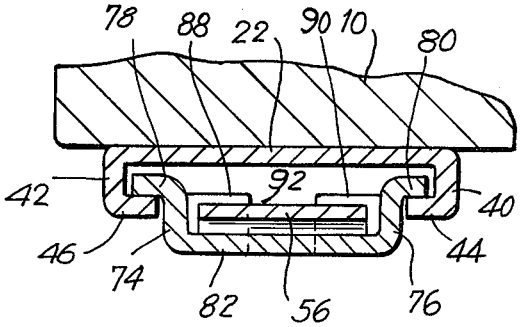
FIG. 6 is a broken-away sectional view as taken along line 6—6 of FIG. 2.

Once the detent arms 88, 90 are slid past the free end 54 of the spring 50, the stressed offset spring portion 56 clears the detent arms, and the offset spring portion 56 snappingly engages behind the detent arms with snap-type action. As best seen in FIGS. 3 and 6, the free end 54 of the offset spring portion 56 is located immediately rearwardly of the detent arms, and particularly in the concave rear surface of the arms. The offset spring portion 56 is securely and tightly held behind the detent arms 88, 90 by the restoring force of the spring which continues to exert pressure against the slide member 66 in order to attempt to return the still-stressed offset spring portion 56 back to its normal unstressed position.

Prior to reaching the assembled condition, it will be noted that a cutout 94 (see FIG. 5) is formed at the rear end of the trailing end section 84. The cutout 94 is dimensioned to clear the rivet head **16*a* so that mechanical interference between the latter and any part of the slide member 66** is avoided during the sliding movement.

The abutment stops 62, 64 are operative to engage the interior rear walls of the trailing end section 84 which are located at either side of the cutout 94. The engagement between the stops 62, 64 and the interior rear walls of the slide member 66 prevent the slide member 66 from being slid past the assembled condition shown in FIGS. 2 and 3.

Figure 4:
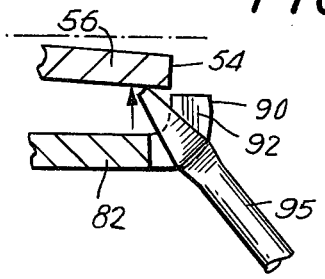
FIG. 4 is an enlarged view of a detail of FIG. 3 showing the operation of a disassembly tool.

In order to remove the slide member 66 from the base member 20, the disassembly is performed by inserting a disassembly tool 95, such as a screw driver, through the access opening 92 and into physical contact with the free spring end 54 which is located immediately underneath the detent arms 88, 90. The tool 95 is manually urged against the spring locking bolt 54 with a displacement force sufficient to counteract the spring restoring force and to displace the offset spring portion 56 back towards the base wall 22 until the spring end 54 clears the detent arms 88, 90. As best shown in the enlarged detail view of FIG. 4, once the free spring locking bolt 54 has cleared the detent arms 88, 90, the slide member 66 is now free to be moved in the reverse direction opposite to the direction of arrow A in order to effect the removal of the slide member 66 from the base member 20.

It will be observed that the spring 50 is the principal part which must be actuated, i.e. depressed, in order to remove the slide member from the base member. As best seen in FIG. 2, the only part of the spring 50 which is exposed is a minor portion of the free spring locking bolt 54, i.e. the minor portion which is located within the access opening 92. Put another way, the spring 50 is located completely within the general outline of the juxtaposed slide member 66. The major portion of the spring is not exposed in the assembled condition, and therefore, the risk of accidental depression of the spring 50 and concomitant separation of the slide member from the base member is extremely remote.

The caster roller device 12 includes a roller or wheel 96, preferably made of synthetic plastic material, which is journaled on a shaft 98 for rotation about a horizontal turning axis. A wheel-supporting bracket has a horizontal base plate 100 and a pair of dependent flange arms 102 (only one illustrated) at opposite sides of the base plate 100, and in which the shaft 98 is mounted. The roller device 12 also includes an upper plate 104 and a ball bearing race 106 located between the upper plate 104 and the base plate 100 in order to permit the wheel 96 and its accompanying bracket to swivel about a vertical axis which lies along the swivel shaft 108. The swivel shaft 108 passes with clearance through a mounting hole 110 centrally formed in the intermediate section 86 of the main body 68 of the slide member 66. The upper end of the swivel shaft 108 can thereupon be peened over, or a headed nut 112 can be provided at the upper end of the shaft 108 to secure the roller device 12 to the slide member 66. If desired, the ball bearing race 106 can be eliminated if the swiveling feature is not needed in a particular application.

The skid-type runner assembly 14 shown in FIG. 7 comprises a slide member 66' which is identical in construction to the aforementioned slide member 66, except in two respects. The structural parts of runner assembly 14 which are identical to that described earlier for the slide member 66 have been identified with primed numerals for ease of identification. As for the differences, the intermediate body section or skid 114 on the runner assembly 14 extends downwardly away from the tracks 70', 72' to a greater extent as compared to the intermediate body section 86 of the slide member 66. Furthermore, the skid 114 on the runner assembly 14 is not provided with any central mounting hole. Instead, the skid 114 on the runner assembly 14 is provided with a plurality of longitudinally-extending, shallow grooves. The grooved skid 114 directly bears against the ground over which the luggage 10 is to be moved.

In accordance with this invention, the skid-type runner assembly 14 of FIG. 7 can readily and easily be interchanged for the aforementioned caster roller assembly which is constituted of the combination of the slide member 66 with its attached caster roller device 12. The runner assembly 14 supports the luggage 10 above the ground as the luggage is dragged thereover. The caster roller assembly shown in FIG. 1 provides rolling engagement of the luggagge with the ground. A piece of luggage can be provided with either one or more skid-type runner units, or one or more caster roller units, or any combination of these two types of units. The base plate is preferably constituted of resilient sheet metal material in order to facilitate the stamping-out of the abutment stops 62, 64 and of the spring 50 from the base wall 22. The slide member 66 and the runner assembly 14 are likewise constituted of metal material.

It will be understood that each of the elements described above, or two or more together, may also find a useful application in other types of constructions differing from the types described above.

While the invention has been illustrated and described as embodied in a detachable luggage support unit, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention, and therefore, such adaptations should and are intended to be comprehended within the meaning and range of equivalence of the following claims.

What is claimed as new and desired to be protected by Letters Patent is set forth in the appended claims.

1. A detachable ground-engaging accessory unit for supporting luggage to be moved from place to place, comprising:

(a) a stationary base member adapted to be secured to the luggage, said base member having an elongated substantially planar base wall and a pair of side rails each extending at least partially along opposite respective longitudinal side edges of the base wall, said base member also having an elongated cantilever leaf spring which includes one spring end connected to the base wall, an opposite free spring end acting as a locking bolt, and a resilient offset spring portion intermediate the spring ends and having a normal position lying out of the plane of the base wall; and (b) a movable slide member having an elongated main body for operatively engaging the ground on which the luggage is to be supported, and a pair of side tracks each extending at least partially along opposite respective longitudinal side edges of the main body, said side tracks slidably engaging the side rails for mounting the slide member on the base member for guided sliding movement between a disassembled and an assembled condition, said slide member having a leading detent portion for cammingly engaging and thereby urging the offset spring portion during said sliding movement towards the base wall until the leading detent portion of the slide member is slid past the locking bolt end of the spring, whereupon the spring due to its inherent resilience engages behind the detent portion with snap-type action to thereby secure the slide member and the base member in said assembled condition, said slide member also having in the vicinity of the leading detent portion an access opening which extends through the slide member to expose the spring locking bolt located therebelow in the assembled condition, said access opening being dimensioned to receive therethrough a disassembly tool operative for displacing the offset spring portion back towards the base wall until the free spring end locking bolt clears the detent portion, whereby the slide member is quickly and easily removed from the base member, said leading detent portion in the assembled condition covering and extending beyond the periphery of the offset spring portion and the free spring locking bolt, except at the access opening, to thereby prevent external forces other than from the tool from displacing the offset spring portion and effecting the disassembled condition, whereby the slide member is not readily detachable from the base member during transport of the object.

2. The accessory unit as defined in claim 1, wherein the stationary base member includes means for securing the same to the object, and wherein the slide member includes means on the same for avoiding mechanical interference with the securing means during said sliding movement.

3. The accessory unit as defined in claim 2, wherein said interference-avoiding means includes a cutout at the trailing end region of the slide member.

4. The accessory unit as defined in claim 1, wherein the cantilever spring is of one-piece with the base wall.

5. The accessory unit as defined in claim 1, wherein the offset spring portion diverges away from the base wall as considered along the direction of advancing movement towards the assembled condition.

6. The accessory unit as defined in claim 1, wherein the stationary base member also has abutment means extending out of the plane of the base wall, and engaging the trailing end region of the slide member in the assembled condition to prevent the slide member from being moved past the assembled condition.

7. The accessory unit as defined in claim 1; and further comprising a caster roller device mounted on the main body of the slide member.

8. The accessory unit as defined in claim 7, wherein the caster roller device is mounted on the slide member for swiveling movement relative thereto.

9. The accessory unit as defined in claim 1; and further comprising a skid formed of one-piece with the main body of the slide member.

10. A detachable ground-engaging accessory unit for supporting luggage to be moved from place to place, comprising:

(a) a stationary base member adapted to be secured to the luggage, said base member having an elongated substantially planar base wall and a pair of side rails each extending at least partially along opposite respective longitudinal side edges of the base wall, said base member also having an elongated cantilever leaf spring which includes one spring end connected to the base wall, an opposite free spring end acting as a locking bolt, and a resilient offset spring portion intermediate the spring ends and having a normal position lying out of the place of the base wall; and (b) a movable slide member having an elongated main body for operatively engaging the ground on which the luggage is to be supported, and a pair of side tracks each extending at least partially along opposite respective longitudinal side edges of the main body, said side tracks slidably engaging the side rails for mounting the slide member on the base member for guided sliding movement between a disassembled and an assembled condition, said slide member having a leading detent portion constituting a pair of downturned arms for cammingly engaging and thereby urging the offset spring portion during said sliding movement towards the base wall until the leading detent portion of the slide member is slid past the free end locking bolt of the spring, whereupon the locking bolt due to the inherent resilience of the spring engages behind the detent portion with snap-type action to thereby secure the slide member and the base member in said assembled condition, said slide member overlying the spring except for a minor portion thereof accessible through an access opening which extends through the slide member between the downturned arms to expose the locking bolt located therebelow in the assembled condition, said access opening being dimensioned to receive therethrough a disassembly tool operative for displacing the offset spring portion back towards the base wall until the free spring locking bolt clears the detent portion, whereby the slide member is quickly and easily removed from the base member and the slide member in assembled condition shields the locking bolt to minimize likelihood of accidental separation of the slide member from the base member.

* * * * *